US009007274B2

(12) United States Patent
Ban et al.

(10) Patent No.: US 9,007,274 B2
(45) Date of Patent: Apr. 14, 2015

(54) RECONFIGURABLE MOBILE PHONE BULIT-IN ANTENNA AND IMPLEMENTATION METHOD THEREOF

(75) Inventors: Yongling Ban, Shenzhen (CN); Peihua Shua, Shenzhen (CN); Ping Lei, Shenzhen (CN); Hengyi Duan, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 412 days.

(21) Appl. No.: 13/529,422

(22) Filed: Jun. 21, 2012

(65) Prior Publication Data

US 2012/0256804 A1 Oct. 11, 2012

Related U.S. Application Data

(60) Provisional application No. PCT/CN2010/079820, filed on Dec. 15, 2010.

(30) Foreign Application Priority Data

Dec. 24, 2009 (CN) ..... 2009 1 0215550

(51) Int. Cl.
*H01Q 1/48* (2006.01)
*H01Q 1/38* (2006.01)
(Continued)

(52) U.S. Cl.
CPC . *H01Q 9/14* (2013.01); *H01Q 1/48* (2013.01); *H01Q 9/0421* (2013.01); *H01Q 1/243* (2013.01); *H01Q 1/245* (2013.01); *H01Q 5/364* (2013.01)

(58) Field of Classification Search
USPC ..... 343/700 MS, 702, 846, 848
See application file for complete search history.

(56) References Cited

U.S. PATENT DOCUMENTS 6,306,976 B1 10/2001 Matsuda et al.
7,714,786 B2 * 5/2010 Chen et al. ..... 343/700 MS
(Continued)

FOREIGN PATENT DOCUMENTS

CN 1391416 A 1/2003
CN 1190101 C 2/2005
(Continued)

OTHER PUBLICATIONS

Written Opinion of the International Searching Authority issued in corresponding PCT Patent Application No. PCT/CN2010/079820, mailed Mar. 24, 2011.
(Continued)

*Primary Examiner* — Tan Ho
(74) *Attorney, Agent, or Firm* — Brinks Gilson & Lione

(57) ABSTRACT

A reconfigurable mobile phone built-in antenna and its implementation method are disclosed. The antenna comprises an antenna main structure, an additional ground area, a ground area printed on one surface of a printed board, an electronic switch and an antenna feeding point and a grounding point printed on the other surface of the printed board, the antenna main structure comprises a wiring structure of the antenna, a feeding spring piece in contact with the antenna feeding point and a grounding spring piece in contact with the grounding point, and the additional ground area is positioned under the wiring structure; the electronic switch is used for disconnecting the additional ground area with the ground area on one surface of the printed board when the antenna works at low-frequency frequency band and connecting the additional ground area with the ground area on when the antenna works at high-frequency frequency band.

7 Claims, 5 Drawing Sheets

(51) Int. Cl.

| | |
|---|---|
| ***H01Q 9/14*** | (2006.01) |
| ***H01Q 9/04*** | (2006.01) |
| ***H01Q 1/24*** | (2006.01) |

(56) References Cited

U.S. PATENT DOCUMENTS

| | | | | |
|---|---|---|---|---|
| 2002/0000941 | A1 | 1/2002 | Johnson | |
| 2004/0130493 | A1 * | 7/2004 | Horita et al. | 343/702 |
| 2008/0238802 | A1 * | 10/2008 | Fukushima | 343/841 |
| 2008/0246674 | A1 * | 10/2008 | Rutfors et al. | 343/722 |
| 2009/0262028 | A1 | 10/2009 | Mumbru et al. | |
| 2009/0285262 | A1 | 11/2009 | Kim | |

FOREIGN PATENT DOCUMENTS

| | | | |
|---|---|---|---|
| CN | 101019273 | A | 8/2007 |
| CN | 101394019 | A | 3/2009 |
| CN | 101431182 | A | 5/2009 |
| CN | 101719584 | A | 6/2010 |
| EP | 1701406 | A1 | 9/2006 |
| WO | WO 2006/031170 | A1 | 3/2006 |
| WO | WO 2011/076075 | A1 | 6/2011 |

OTHER PUBLICATIONS

Office Action issued in corresponding Chinese Patent Application No. 200910215550.4, mailed Feb. 29, 2012.

International Search Report issued in corresponding PCT Patent Application No. PCT/CN2010/079820, mailed Mar. 24, 2011.

Office Action issued in corresponding Korean Patent Application No. 10-2012-7019135, mailed Jul. 3, 2013, 8 pages.

Extended European Search Report issued in corresponding European Patent Application No. 10838638.4, mailed Jun. 17, 2013, 7 pages.

* cited by examiner

RECONFIGURABLE MOBILE PHONE BULIT-IN ANTENNA AND IMPLEMENTATION METHOD THEREOF

CROSS-REFERENCE TO RELATED APPLICATION

This application is a continuation of International Application PCT/CN2010/079820, filed on Dec. 15, 2010, which claims priority to Chinese Patent Application No. 200910215550.4, filed on Dec. 24, 2009, both of which are hereby incorporated by reference in their entireties.

TECHNICAL FIELD

Embodiments of the present invention relate generally to antenna technologies, and more particularly, to a reconfigurable mobile phone built-in antenna and implementation method thereof.

BACKGROUND

Antenna design for mobile phones faces two problems: first, how to obtain a larger bandwidth as much as possible while operating at low-frequency frequency band, and second, how to prevent Specific Absorption Rate (SAR) (which is an indicator for measuring mobile phone electromagnetic radiation intensity) from increasing while operating at high-frequency frequency band. Generally, there exist two commonly-used schemes for mobile phone antenna: Monopole antenna and PIFA antenna. The Monopole antenna has a wide bandwidth but a high SRA, while the PIFA antenna has a narrow bandwidth but a low SRA. In the prior art, it is hard to acquire the optimal performance experience by employing a single Monopole antenna or PIFA antenna in finite space.

SUMMARY

The embodiments of the present invention provide a reconfigurable mobile phone built-in antenna and an implementation method thereof to achieve the optimal performance for the mobile phone.

The embodiments of the present invention provide a reconfigurable mobile phone built-in antenna, comprising: an antenna main structure, an additional ground area, a ground area printed on one surface of a printed board, an electronic switch, and an antenna feeding point and a grounding point printed on the other surface of the printed board; wherein the antenna main structure comprises a wiring structure of the antenna, a feeding spring piece which is in contact with the antenna feeding point, and a grounding spring piece which is in contact with the grounding point; the additional ground area is positioned just under the wiring structure; the electronic switch is used for disconnecting the additional ground area with the ground area on one surface of the printed board when the antenna works at low-frequency frequency band, and connecting the additional ground area with the ground area on one surface of the printed board when the antenna works at high-frequency frequency band.

The embodiments of the present invention provide an implementation method for a reconfigurable mobile phone built-in antenna, comprising: determining a operating frequency band at which the antenna operates; and, disconnecting the additional ground area with the ground area on one surface of the printed board by an electronic switch when the operating frequency band is low-frequency frequency band, and connecting the additional ground area with the ground area on one surface of the printed board by an electronic switch when the operating frequency band is high-frequency frequency band.

In the embodiments of the present invention, by configuring the electronic switches, the antennas may disconnect the ground area on one surface of the printed board with the additional ground area while operating at low-frequency frequency band to present the characteristic of Monopole antenna that has a large bandwidth, and connect the ground area on one surface of the printed board with the additional ground area while operating at high-frequency frequency band to present the characteristic of PIFA antenna that has a lower SAR value, so as to achieve the optimal performance for the mobile phone.

BRIEF DESCRIPTION OF THE DRAWINGS

The accompanying drawings which form a part of the disclosure rather than the limitation to the present invention are set forth in order to provide a further understanding of the present invention, in which.

DETAILED DESCRIPTION

To clarify the purposes, technical solutions, and advantages of the present invention, the present invention now will be described more detail hereinafter with reference to various implementations and accompanying drawings. The exemplary implementations and description thereof herein are provided only for the purpose of illustrating the present invention, rather than the limitation to the present invention.

Figure 1:
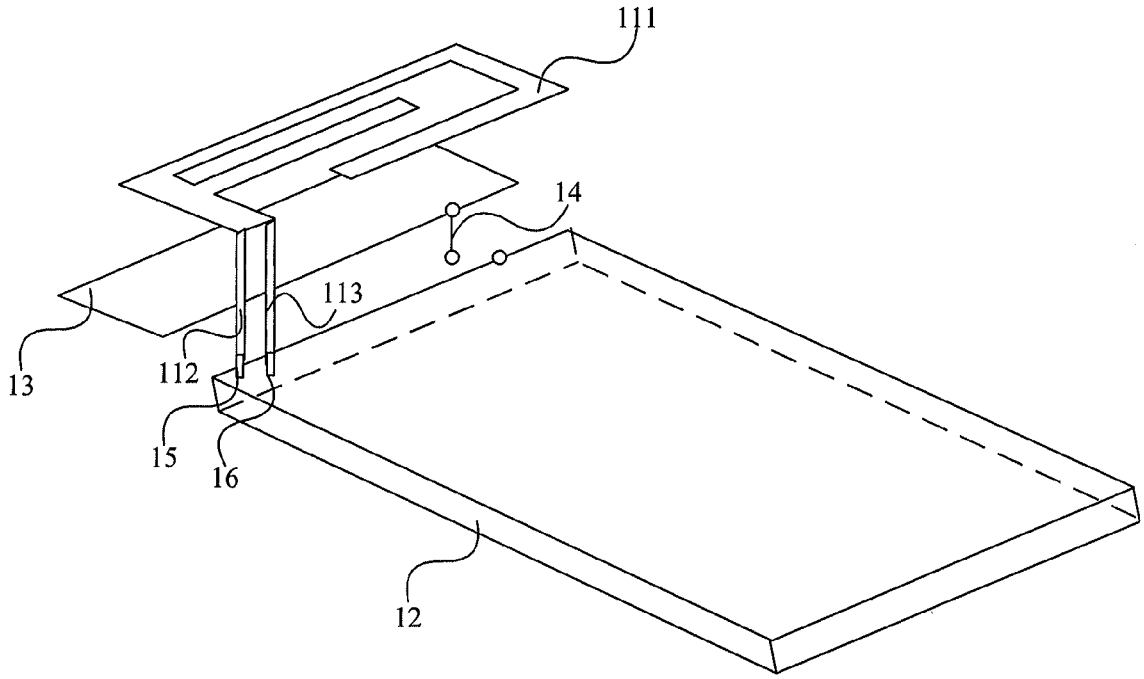
FIG. 1 illustrates a structure schematic diagram of a reconfigurable mobile phone built-in antenna according to a first embodiment of the present invention.

FIG. 1 illustrates a structure schematic diagram of a reconfigurable mobile phone built-in antenna according to a first embodiment of the present invention. The reconfigurable mobile phone built-in antenna may comprise an antenna main structure, a ground area 12 printed on one surface of a printed board, an additional ground area 13, an electronic switch 14, and an antenna feeding point 15 and a grounding point 16 printed on the other surface of the printed board. The antenna main structure may comprise a wiring structure 111 of the antenna, a feeding spring piece 112 and a grounding spring piece 113. The feeding spring piece 112 may be in contact with the antenna feeding point 15. The grounding spring piece 113 may be in contact with the grounding point 16. Via the grounding point 15, the circuit system on the printed board may excite high frequency current on the antenna main structure, and thus form radiation electromagnetic waves in space. The additional ground area 13 is positioned just under the wiring structure 111 in the antenna main structure. The electronic switch 14 is used for disconnecting the ground area 12 on one surface of the printed board with the additional ground area 13 when the antenna works at low-frequency frequency band, and connecting the ground area 12 on one surface of the printed board with the additional ground area 13 when the antenna works at high-frequency frequency band.

According to the formation principle of the PIFA and Monopole antenna, when the additional ground area under the antenna main structure is in a non-floating state, i.e., the additional ground area is connected to the ground area on one surface of the printed board, the antenna may present the characteristics of PIFA antenna, and when the additional ground area under the antenna main structure is in a floating state, i.e., the additional ground area is disconnected to the ground area on one surface of the printed board, the antenna may present the characteristics of Monopole antenna.

As such, in this embodiment, the electronic switch 14 is configured to disconnect the additional ground area 13 with the ground area 12 on one surface of the printed board when the antenna works at low-frequency frequency band, and connect the additional ground area 13 with the ground area 12 on one surface of the printed board when the antenna works at high-frequency frequency band, so that the antenna may present the characteristics of Monopole antenna during operating at low-frequency frequency band, and may present the characteristics of PIFA antenna during operating at high-frequency frequency band.

As those skilled in the art know, the main problems that need to be solved relate to a wider operating bandwidth when the antenna operates at low-frequency frequency band, and a lower SAR value when the antenna operates at high-frequency frequency band.

Accordingly, in this embodiment, to achieve the optimal performance for the mobile phone, the antenna has a wider operating bandwidth when it presents the characteristics of Monopole antenna, thereby solving the problem that a wider operating bandwidth is needed in the low-frequency frequency band; and the antenna has a lower SAR value when it presents the characteristics of PIFA antenna, thereby solving the problem that a lower SAR value is needed in the high-frequency frequency band.

In this embodiment, whether the system operates at low-frequency or high-frequency frequency band may be detected via a PCB circuit, by which the electronic switch is controlled, in the mobile phone. Whether a mobile phone operates at low frequency or high frequency in a region is generally determined by the operator's network. Upon detecting the frequency band in the network, the PCB circuit in the mobile phone may output a control signal to drive the connecting and disconnecting of the electronic switches, wherein the low-frequency frequency band refers to 824-960 MHz, and the high-frequency frequency band refers to 1710-2170 MHz.

In this embodiment, the shape of the wiring structure in the antenna main structure may be any suitable shape that has a meander-line structure. The shape of the additional ground area 13 also may be arbitrary. The number of the electronic switch 14 may be, but not limited to, one or more. With a plurality of electronic switches, the connection between the additional ground and the printed board ground may present a more effective ground-effect with regard to the antenna, so as to make the electromagnetic field that radiates toward the direction of the human head weaker, which benefits the reducing of the SAR value.

In this embodiment, by configuring the electronic switches, the antennas of this embodiment may present the characteristic of Monopole antenna in the low-frequency frequency band, and may present the characteristic of FIFA antenna in the high-frequency frequency band, so as to achieve the optimal performance for the mobile phone.

In the actual implementation, according to the shape of the additional ground area, the number and position of the electronic switch may be configured in different ways, take the following embodiments as examples specifically.

In implementation, the wiring structure may be supported with antenna mount, and may be fixed along with the ground area on one surface of a printed board as well as the additional ground area by a structure component such as mobile phone housing.

Figure 2:
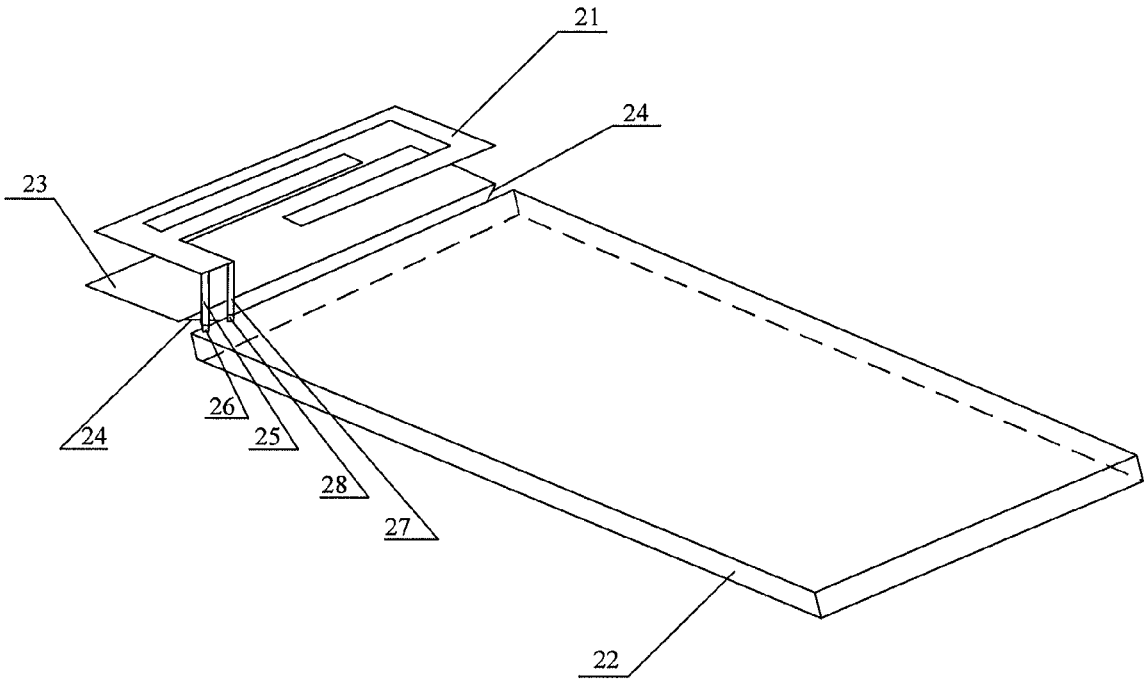
FIG. 2 illustrates a structure schematic diagram of a reconfigurable mobile phone built-in antenna according to a second embodiment of the present invention.

FIG. 2 illustrates a structure schematic diagram of a reconfigurable mobile phone built-in antenna according to a second embodiment of the present invention. The reconfigurable mobile phone built-in antenna may comprise a wiring structure 21, a ground area on one surface of a printed board 22, an additional ground area 23, an electronic switch 24, a feeding spring piece 25, a feeding point 26, a grounding spring piece 27 and a grounding point 28, the feeding point 26 and the grounding point 28 are printed on the other surface of the printed board. The wiring structure 21 is connected to the feeding spring piece 25 and the grounding spring piece 27. The feeding spring piece 25 is in contact with the feeding point 26, for example, in a crimping manner. The grounding spring piece 27 is in contact with the grounding point 28, for example, in a crimping manner. The additional ground area 23 is positioned just under the wiring structure 21 in the antenna main structure. The electronic switch 24 is used for disconnecting the ground area 22 on one surface of the printed board with the additional ground area 23 when the antenna works at low-frequency frequency band, and connecting the ground area 22 on one surface of the printed board with the additional ground area 23 when the antenna works at high-frequency frequency band, wherein the surface of the ground area 22 on one surface of the printed board and the additional ground area 23 is attached with metal layer to achieve the conductivity function.

In this embodiment, whether the system operates at low-frequency or high-frequency frequency band may be detected via a function module, by which the electronic switch is controlled, on the printed board of the mobile phone, wherein the low-frequency frequency band refers to 824-960 MHz, and the high-frequency frequency band refers to 1710-2170 MHz.

In this embodiment, the additional ground area 23 may be illustrated as FIG. 2.

The shape of the wiring structure 21 in this embodiment is not limited to that as illustrated in FIG. 2, and may be other shape. Although two electronic switches are illustrated in FIG. 2, the number of the electronic switches in this embodiment is not limited to two, which may be one or more than two. Also, the position of the electronic switches is not limited to that as illustrated in FIG. 2. The electronic switches in this embodiment may be implemented with diode or frequency selective network, or other elements having switching function. With a plurality of electronic switches, the connection between the additional ground and the printed board ground may be made to present more effective ground-effect with regard to the antenna, so as to make the electromagnetic field that radiates toward the direction of the human head weaker, which benefits the reducing of the SAR value.

In this embodiment, the position of the feeding spring piece, the feeding point, the grounding spring piece and the grounding point is not limited to that as illustrated in FIG. 2, and may be adjusted appropriately according to the actual configuration.

In implementation, the wiring structure may be supported with antenna mount, and may be fixed along with the ground area on one surface of a printed board as well as the additional ground area by a structure component such as mobile phone housing.

In this embodiment, by configuring the electronic switches, the antennas of this embodiment may present the characteristic of Monopole antenna in the low-frequency frequency band, and present the characteristic of PIFA antenna in the high-frequency frequency band, so as to achieve the optimal performance for the mobile phone.

Figure 3:
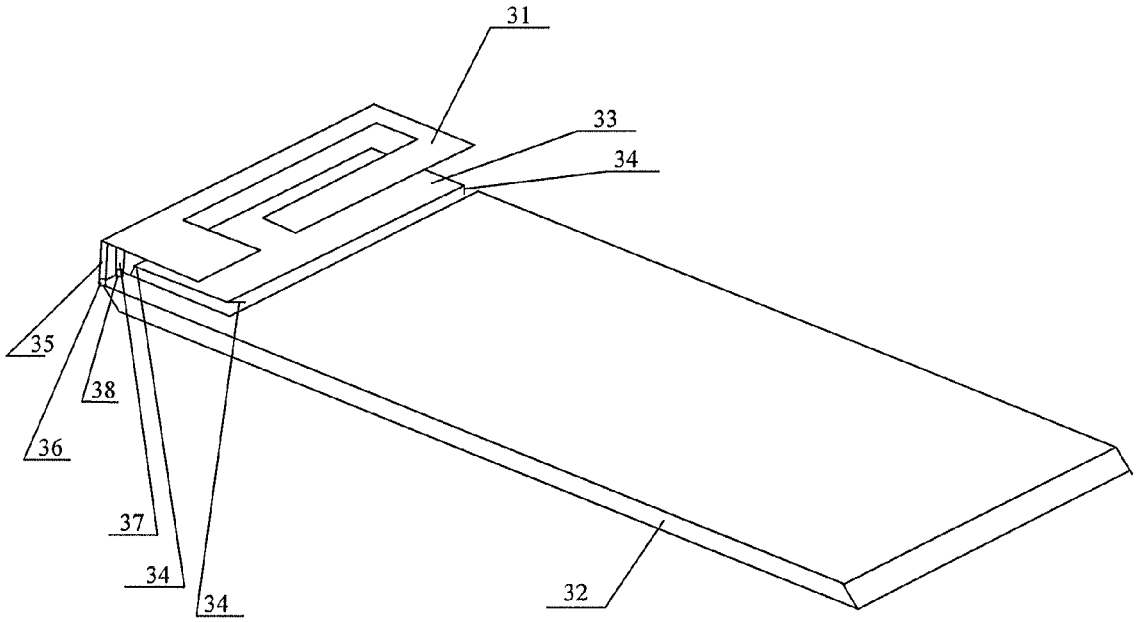
FIG. 3 illustrates a structure schematic diagram of a reconfigurable mobile phone built-in antenna according to a third embodiment of the present invention.

FIG. 3 illustrates a structure schematic diagram of a reconfigurable mobile phone built-in antenna according to a third embodiment of the present invention. The reconfigurable mobile phone built-in antenna may comprise a wiring structure 31, a ground area 32 on one surface of a printed board, an additional ground area 33, an electronic switch 34, a feeding spring piece 35, a feeding point 36, a grounding spring piece 37 and a grounding point 38, the feeding point 36 and the grounding point 38 are printed on the other surface of the printed board. The wiring structure 31 is connected to the feeding spring piece 35 and the grounding spring piece 37. The feeding spring piece 35 is in contact with the feeding point 36, for example, in a crimping manner. The grounding spring piece 37 is in contact with the grounding point 38, for example, in a crimping manner. The additional ground area 33 is positioned just under the wiring structure 31 in the antenna main structure. The electronic switch 34 is used for disconnecting the ground area 32 on one surface of the printed board with the additional ground area 33 when the antenna works at low-frequency frequency band, and connecting the ground area 32 on one surface of the printed board with the additional ground area 33 when the antenna works at high-frequency frequency band, wherein the surface of the ground area 32 on one surface of the printed board and the additional ground area 33 is attached with metal layer to achieve the conductivity function.

In this embodiment, whether the system operates at low-frequency or high-frequency frequency band may be detected via a function module, by which the electronic switch is controlled, on the PCB of the mobile phone, wherein the low-frequency frequency band refers to 824-960 MHz, and the high-frequency frequency band refers to 1710-2170 MHz.

In this embodiment, the additional ground area 33 may be illustrated as FIG. 3.

The shape of the wiring structure 31 in this embodiment is not limited to that as illustrated in FIG. 3, and may be other shape.

Although three electronic switches are illustrated in FIG. 3, the number of the electronic switches in this embodiment is not limited to three, which may be one or two or more than three. Also, the position of the electronic switches is not limited to that as illustrated in FIG. 3. The electronic switches in this embodiment may be implemented with diode or frequency selective network, or other elements having switching function. With a plurality of electronic switches, the connection between the additional ground and the printed board ground may be made to present more effective ground-effect with regard to the antenna, so as to make the electromagnetic field that radiates toward the direction of the human head weaker, which benefits the reducing of the SAR value.

In this embodiment, the position of the feeding spring piece, the feeding point, the grounding spring piece and the grounding point is not limited to that as illustrated in FIG. 3, and may be adjusted appropriately according to the actual configuration.

In implementation, the wiring structure may be supported with antenna mount, and may be fixed along with the ground area on one surface of a printed board as well as the additional ground area by a structure component such as mobile phone housing.

In this embodiment, by configuring the electronic switches, the antennas of this embodiment may present the characteristic of Monopole antenna in the low-frequency frequency band, and present the characteristic of PIFA antenna in the high-frequency frequency band, so as to achieve the optimal performance for the mobile phone.

Figure 4:
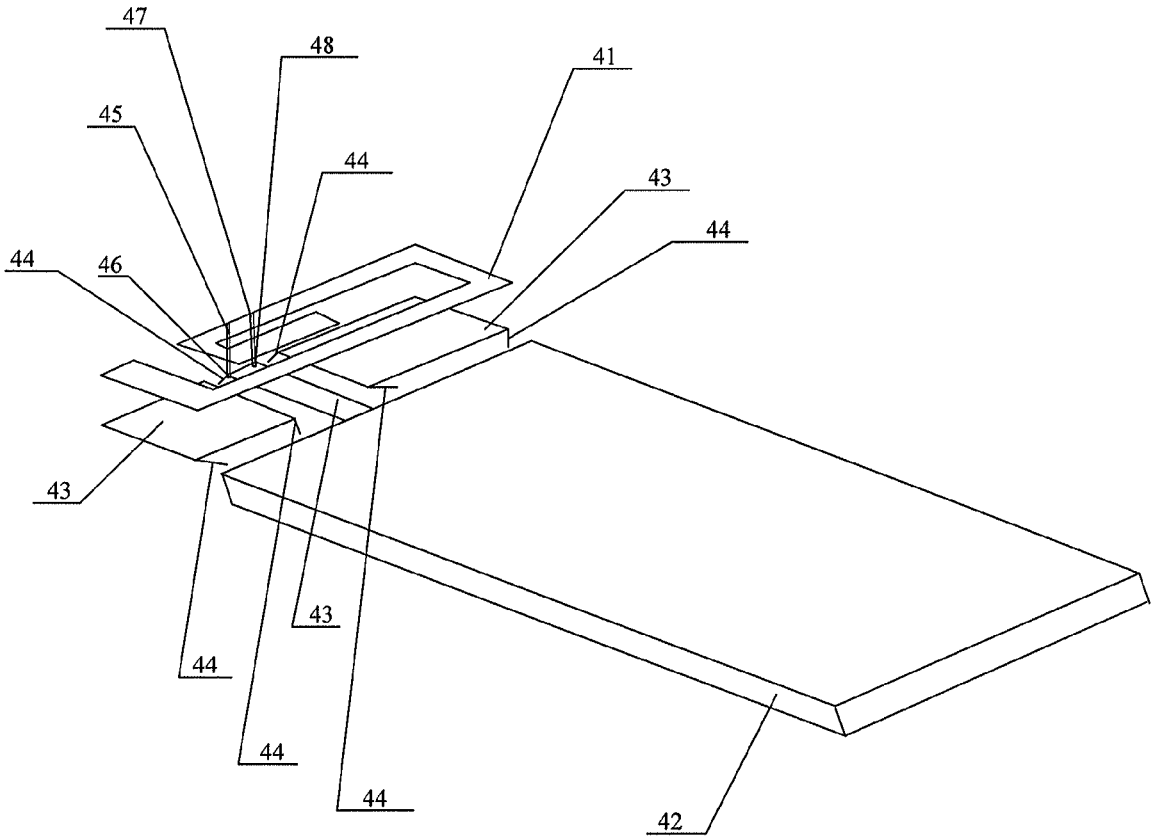
FIG. 4 illustrates a structure schematic diagram of a reconfigurable mobile phone built-in antenna according to a fourth embodiment of the present invention.

FIG. 4 illustrates a structure schematic diagram of a reconfigurable mobile phone built-in antenna according to a third embodiment of the present invention. The reconfigurable mobile phone built-in antenna may comprise a wiring structure 41, a ground area 42 on one surface of a printed board, an additional ground area 43, an electronic switch 44, a feeding spring piece 45, a feeding point 46, a grounding spring piece 47 and a grounding point 48, the feeding point 46 and the grounding point 48 are printed on the other surface of the printed board. The wiring structure 41 is connected to the feeding spring piece 45 and the grounding spring piece 47. The feeding spring piece 45 is in contact with the feeding point 46, for example, in a crimping manner. The grounding spring piece 47 is in contact with the grounding point 48, for example, in a crimping manner. The additional ground area 43 is positioned just under the wiring structure 41 in the antenna main structure. The electronic switch 44 is used for disconnecting the ground area 42 on one surface of the printed board with the additional ground area 43 when the antenna works at low-frequency frequency band, and connecting the ground area 42 on one surface of the printed board with the additional ground area 43 when the antenna works at high-frequency frequency band, wherein the surface of the ground area 42 on one surface of the printed board and the additional ground area 43 is attached with metal layer to achieve the conductivity function.

In this embodiment, whether the system operates at low-frequency or high-frequency frequency band may be detected via a function module, by which the electronic switch is controlled, on the PCB of the mobile phone, wherein the low-frequency frequency band refers to 824-960 MHz, and the high-frequency frequency band refers to 1710-2170 MHz.

In this embodiment, the additional ground area 43 may be illustrated as FIG. 4

The shape of the wiring structure 41 in this embodiment is not limited to that as illustrated in FIG. 4, and may be other shape.

Although six electronic switches are illustrated in FIG. 4, the number of the electronic switches in this embodiment is not limited to six, which may be less or more than six. Also, the position of the electronic switches is not limited to that as illustrated in FIG. 4. The electronic switches in this embodiment may be implemented with diode or frequency selective network, or other elements having switching function. With a plurality of electronic switches, the connection between the additional ground and the printed board ground may be made to present more effective ground-effect with regard to the antenna, so as to make the electromagnetic field that radiates toward the direction of the human head weaker, which benefits the reducing of the SAR value.

In this embodiment, the position of the feeding spring piece, the feeding point, the grounding spring piece and the grounding point is not limited to that as illustrated in FIG. 4, and may be adjusted appropriately according to the actual configuration.

In implementation, the wiring structure may be supported with antenna mount, and may be fixed along with the ground area on one surface of a printed board as well as the additional ground area by a structure component such as mobile phone housing.

In this embodiment, by configuring the electronic switches, the antennas of this embodiment may present the characteristic of Monopole antenna in the low-frequency frequency band, and present the characteristic of PIFA antenna in the high-frequency frequency band, so as to achieve the optimal performance for the mobile phone.

In the above embodiments, since the distribution of electromagnetic field radiated outward by the antenna may be different as the variations of the shape of the additional ground area, some of parameters of the antenna will be different. Accordingly, the different shape of the additional ground area may be selected according to the different requirements.

Figure 5:
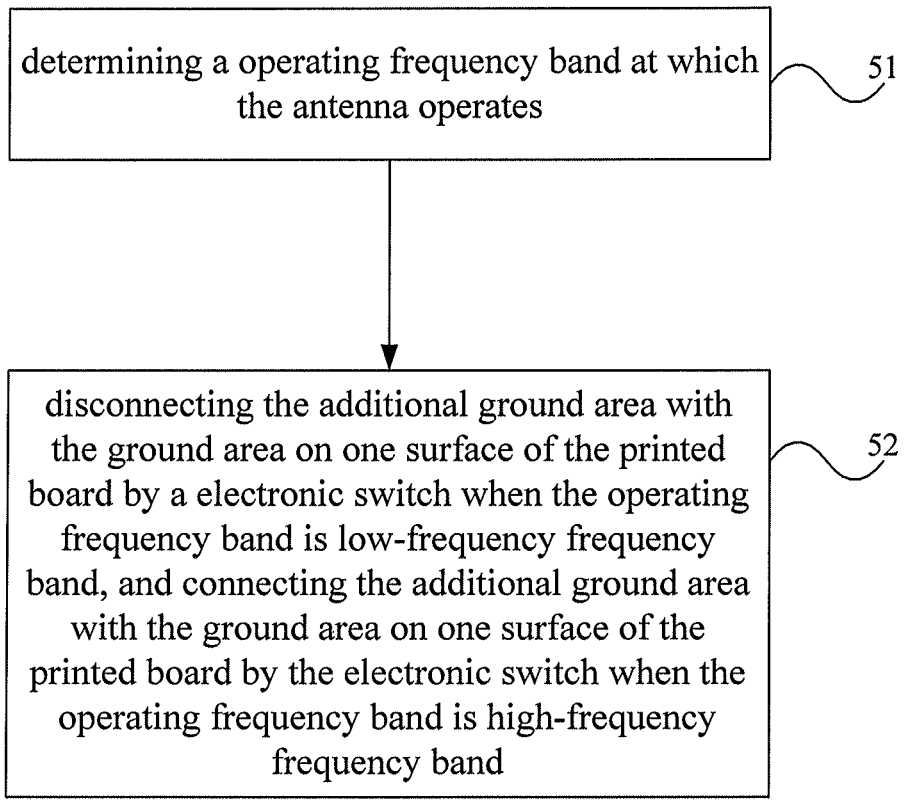
FIG. 5 is a method flowchart diagram of a fifth embodiment of the present invention.

FIG. 5 is a method flowchart diagram of a fifth embodiment of the present invention, which comprises:

step 51: determining a operating frequency band at which the antenna operates; and step 52: disconnecting the additional ground area with the ground area on one surface of the printed board by a electronic switch when the operating frequency band is low-frequency frequency band, and connecting the additional ground area with the ground area on one surface of the printed board by the electronic switch when the operating frequency band is high-frequency frequency band.

In this embodiment, whether the system operates at low-frequency or high-frequency frequency band may be detected via a function module, by which the electronic switch is controlled, on the printed board of the mobile phone, wherein the low-frequency frequency band refers to 824-960 MHz, and the high-frequency frequency band refers to 1710-2170 MHz. The electronic switches in this embodiment may be implemented with diode or frequency selective network, or other elements having switching function. The number of the electronic switches in this embodiment may be one or more.

The additional ground area is a ground area that is positioned under the antenna main structure. When the additional ground area is disconnected with the ground area on one surface of a printed board, the antenna may present the characteristic of Monopole antenna that has a wider operating bandwidth. When the additional ground area is connected with the ground area on one surface of a printed board, the antenna may present the characteristic of PIFA antenna that has a lower SAR value.

In this embodiment, by controlling the disconnection and connection between an additional ground area and an ground area on one surface of a printed board by an electronic switch, the antenna may present the characteristic of Monopole antenna in low-frequency frequency band, and present the characteristic of PIFA antenna in high-frequency frequency band to achieve optimal performance for the mobile phone.

Those skilled in the art will understand that all or parts of the steps that can implement the above method embodiment may be performed by a hardware related to program instructions. The aforementioned program may be stored on computer-readable medium. When the program is executed, the steps including the above method embodiment may be performed. The aforementioned storage medium may include a variety of medium that can store program code, such as ROM, RAM, magnetic disk or optical disc.

In the above specific implementations, the purposes, technical solutions and beneficial effects of the present invention has seen described. It will be appreciated that the above description is not intended to limit the protection scope of the present invention, but is merely to be the specific implementation of the present invention. Any modifications, equivalent substitutions, improvements and so on should be included within the protection scope of the present invention without departing from the spirit and principle of the present invention.

What is claimed is:

1. A reconfigurable mobile phone built-in antenna, comprising:

an antenna main structure, an additional ground area, a ground area printed on one surface of a printed board, an electronic switch and an antenna feeding point and a grounding point printed on the other surface of the printed board;

wherein the antenna main structure comprises a wiring structure of an antenna, a feeding spring piece which is in contact with the antenna feeding point and a grounding spring piece which is in contact with the grounding point;

the additional ground area is positioned just under the wiring structure;

the electronic switch is configured to disconnect the additional ground area with the ground area on the one surface of the printed board when the antenna works at low-frequency frequency band and to connect the additional ground area with the ground area on the one surface of the printed board when the antenna works at high-frequency frequency band, wherein when the additional ground area is disconnected with the ground area on the one surface of the printed board, the antenna is configured to be Monopole antenna; and when the additional ground area is connected with the ground area on the one surface of the printed board, the antenna presents is configured to be PIFA antenna.

2. The antenna of claim 1, wherein, the low-frequency frequency band is 824-960 MHz, and the high-frequency frequency band is 1710-2170 MHz.

3. The antenna of claim 1, wherein, the electronic switch includes one or more electronic switches.

4. The antenna of claim 1, wherein, the electronic switch is implemented with diode or frequency selective network.

5. The antenna of claim 1, wherein, the feeding spring piece and the grounding spring piece in the antenna main structure are in contact respectively with the antenna feeding point and the grounding point in the other surface of the printed board in a crimping manner.

6. A method for implementing a reconfigurable mobile phone built-in antenna, comprising:

determining an operating frequency band at which the antenna operates; and disconnecting an additional ground area with a ground area on one surface of a printed board by an electronic switch when the operating frequency band is low-frequency frequency band, and connecting the additional ground area with the ground area on the one surface of the printed board by the electronic switch when the operating frequency band is high-frequency frequency band, wherein when the additional ground area is disconnected with the ground area on the one surface of the printed board, the antenna presents configured to be Monopole antenna; and when the additional ground area is connected with the ground area on the one surface of the printed board, the antenna is configured to be PIFA antenna.

7. The method of claim 6, wherein, the low-frequency frequency band is 824-960 MHz, and the high-frequency frequency band is 1710-2170 MHz.

* * * * *

UNITED STATES PATENT AND TRADEMARK OFFICE

CERTIFICATE OF CORRECTION

PATENT NO. : 9,007,274 B2
APPLICATION NO. : 13/529422
DATED : April 14, 2015
INVENTOR(S) : Yongling Ban et al.

It is certified that error appears in the above-identified patent and that said Letters Patent is hereby corrected as shown below:

On the Title Page

Left column, item (54) and in the Specification, in column 1, in the title, line 2, replace "BULIT-IN" with --BUILT-IN--.

Left column, item (75), replace "Peihua Shua" with --Peihua Shuai--.

Left column, item (60), replace "Provisional" with --Continuation of--.

Signed and Sealed this
Twenty-second Day of September, 2015

Michelle K. Lee

Michelle K. Lee
*Director of the United States Patent and Trademark Office*